United States Patent [19]

Appelbaum

[11] Patent Number: 4,649,723

[45] Date of Patent: Mar. 17, 1987

[54] PORTABLE SAFE FOR SMALL ITEMS

[76] Inventor: Paul Appelbaum, 5115 E. Donald St., Denver, Colo. 80222

[21] Appl. No.: 840,097

[22] Filed: Mar. 17, 1986

[51] Int. Cl.[4] ..... E05B 65/48

[52] U.S. Cl. ..... 70/63; 70/DIG. 63

[58] Field of Search ..... 70/63, 14, 52, 53, 51, 70/54, 56, DIG. 63; 109/23, 52, 45, 59

[56] References Cited

U.S. PATENT DOCUMENTS

| | | | |
|---|---|---|---|
| 3,979,932 | 9/1976 | Piche | 70/63 |
| 4,325,240 | 4/1982 | Gable | 70/284 |
| 4,532,783 | 8/1985 | Maurice | 70/63 |

*Primary Examiner*—Robert L. Wolfe

*Attorney, Agent, or Firm*—Charles C. Corbin

[57] ABSTRACT

Portable safe for securing small items, having a storage case with bottom and spaced side walls that define a storage space, and a front portion hingedly mounted to the forward part of the case and which retains a padlock internally with the padlock shackle protruding through a front wall of the front portion for securing the safe to a fixed external member, and a lid slidably mounted in grooves in the upper part of the case and mounting a lock which, when the lid is slid to cover the storage space, makes locking engagement with a latch on the hinged front portion and holds the front portion against pivotal movement.

12 Claims, 5 Drawing Figures

Fig. 3
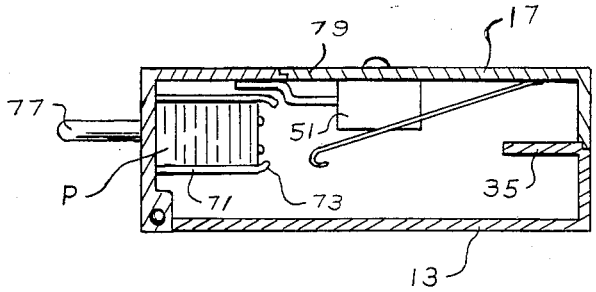
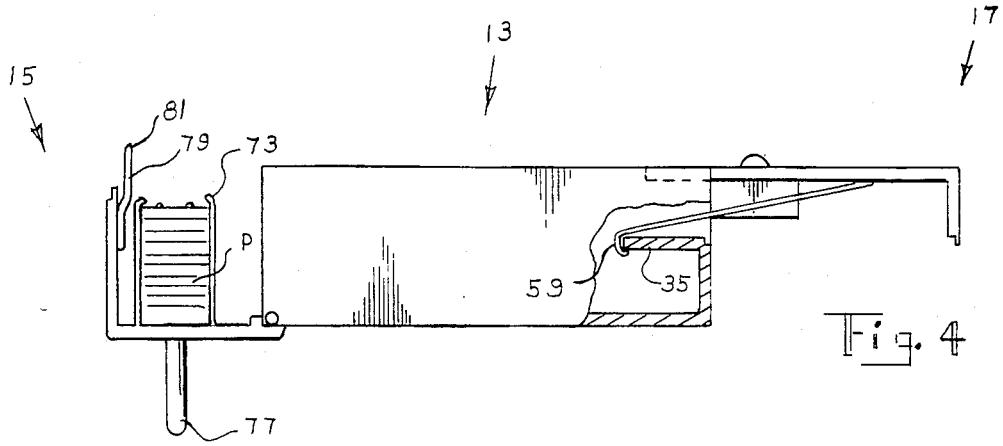
Fig. 4
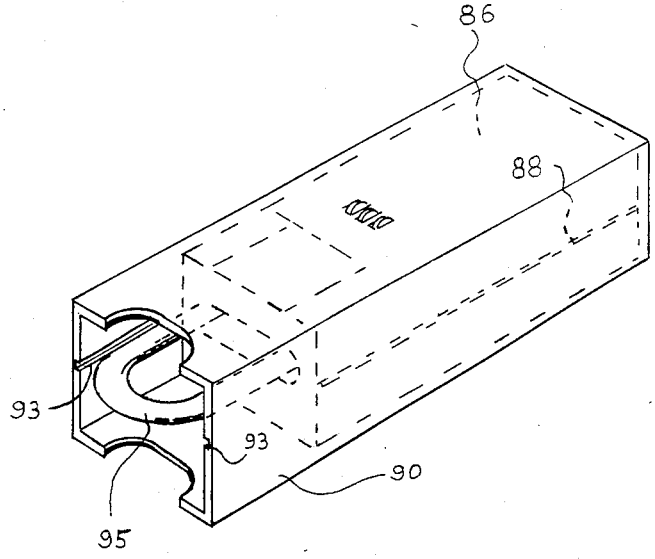
Fig. 5

PORTABLE SAFE FOR SMALL ITEMS

BACKGROUND

In view of epidemic crime there is a great need for a convenient, effective and inexpensive device for securing small valuable items such as jewelry, currency, and the like, against theft. There is also a need for suitable means for storing small items such as keys, access cards and computer access codes to which access must be limited to only authorized individuals. It is also desirable that such safekeeping means be portable and lockable to a fixed structure.

Conventional means for addressing these needs include the use of the so-called key safes and lock boxes such as shown in Williams, U.S. Pat. No. 3,084,532, Piche, U.S. Pat. No. 3,979,932 and Barrett, U.S. Pat. No. 3,436,937, which devices generally have a housing with means for mounting to a door knob or other fixed article and having a releasable cover providing access to an interior compartment which cover is locked thereto by a key or combination operated lock. One of the drawbacks of these approaches is that access to the safe interior provides one with the ability to release the shackle that mounts the safe to a fixed structure. This permits theft of the device by an individual who has obtained unauthorized access to the safe key or combination. Another drawback of conventional devices is that they tend to be specially designed for key stowing and do not have a general applicability for a variety of small items.

SUMMARY OF INVENTION

In view of the foregoing it is an object of the invention to provide a portable safe for small items in which access to the storage compartment does not permit unrestricted unlatching of means for attaching the safe to a fixed structure.

Another object of the invention is to provided a portable safe in which the means for attaching the safe to fixed articles must be unlocked via a key way located within its storage compartment.

A further object is to provide a portable safe which employs a standard padlock.

A still further object is to provide a portable safe that has means to shield the shackle of an employed padlock.

Yet another object is to provide an inexpensive and robust portable safe.

Further objects of the invention will become apparent upon referring to the brief summary below, the detailed description thereafter following and the drawings annexed hereto.

According the present invention provides a portable safe for small items that includes a storage case having a bottom, spaced side walls and a rear wall. There is a front, padlock holding portion that is hingedly mounted to the forward, bottom part of the case for pivoting about a transverse axis. This portion retains the body of a padlock while permitting the padlock shackle to extend through an opening in the front wall of this padlock holding portion. This portion also has latch means affixed thereto. The hinge allows the holding portion to rotate away from the case for easier access to the keyway of the padlock. The invention includes a lid which slidably engages grooves in the upper part of the case to cover and uncover the top of the case. Locking means affixed to the lid will engage the latch on the padlock holding portion when the lid is closed. The lid will then also engage the top wall of the padlock holding portion to hold it against pivoting movement.

BRIEF DESCRIPTION OF THE DRAWINGS

FIG. 3 is a cross-sectional view taken along lines 3—3 shown in FIG. 1;

FIG. 4 is a side elevational view illustrating the operation of the device of FIG. 1; and FIG. 5 is a perspective view showing a varient of the invention.

DETAILED DESCRIPTION

Figure 2:
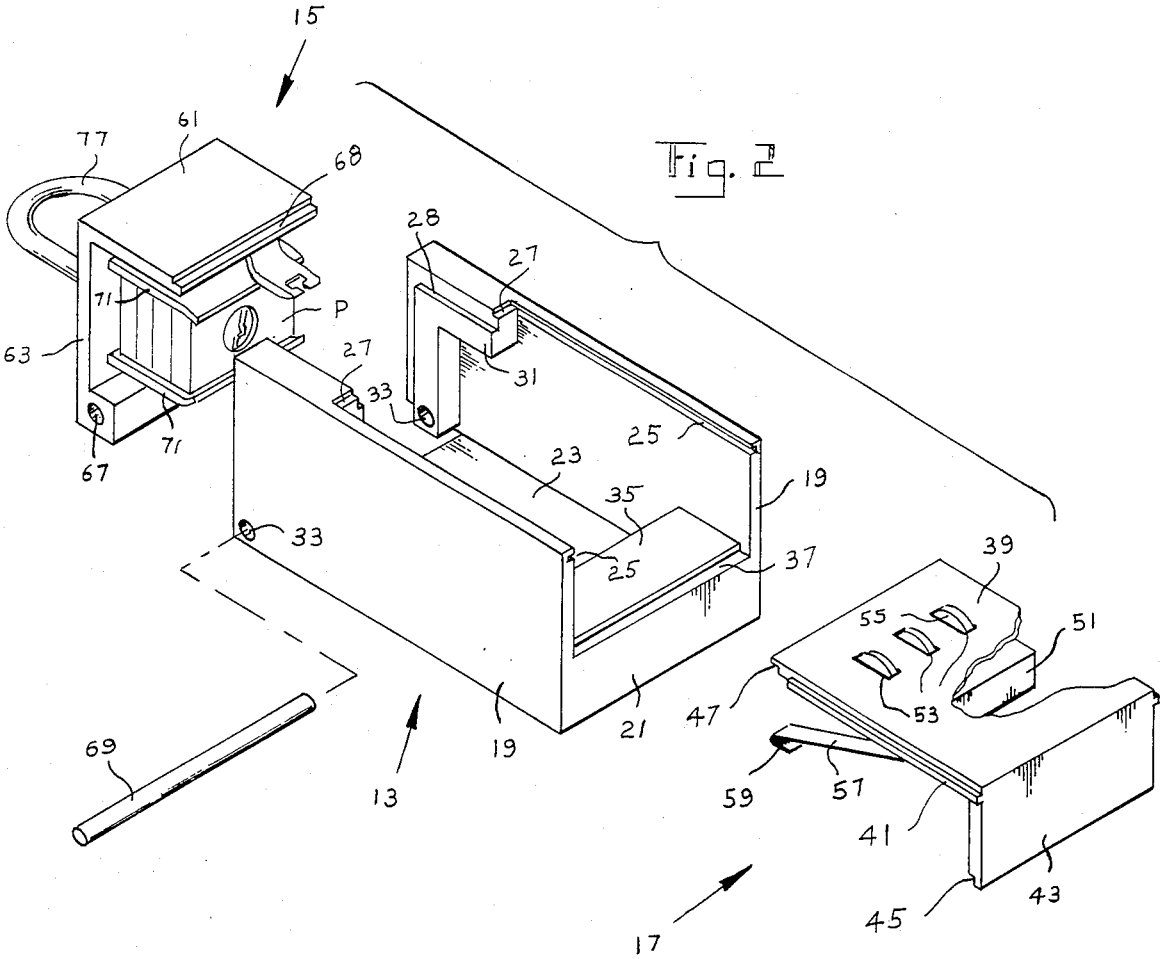
FIG. 2 is an exploded isometric view of the device shown in FIG. 1.

A portable safe according to the invention is shown in FIG. 2 with its three main components—the case 13, padlock hold 15 and lid 17 shown in exploded view to illustrate their salient features and the method of assembly thereof. These components may be preferrably formed of stainless steel or aluminum alloy by various fabrication techniques well known in the metal working industry. The case 13 has spaced-apart side walls 19, rear wall 21 and bottom 23. A pair of longitudinal grooves 25 extend along the inner top portions of side walls 19 and terminate at traverse recessed seats 27 which lie along rear ends of reinforced wall portions 31. These reinforced wall portions 31 also have recessed seats 28 along their inside edges and holes 33 at their lower front ends. A shelf 35 extends between walls 19 and adjoins the top of rear wall 21 at seat 37.

A longitudinal tongue 41 extends along the side edges of the top wall 39 of lid 17. The lid rear wall 43 has a recessed edge 45 across its lower edge. The lid top 39 also has a recessed forward edge 47. There is a resetable combination lock 51, of conventional design, affixed to the underside of lid top 39 in which lie longitudinal slots 53 that admit the knobs 55 of lock 51. There are forwardly facing latch-receiving openings (not shown) in lock 51. A resilient catch 57, lying to one side of lock 51, and having a hooked end 59, depends obliquely forward from its point of affixation of the bottom of wall 39.

Figure 1:
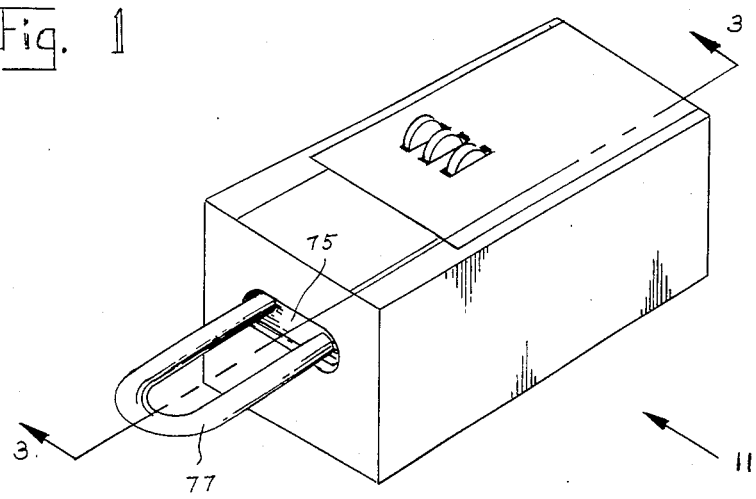
FIG. 1 is a perspective view showing a device of the invention.

The padlock holder 15 has top wall 61 and a front wall 63 that has a reinforced lower end 65 containing transverse bore 67. Top wall 61 has a recessed lip portion 68 along its rear edge. The reinforced end 65 and the portion 31 are of greater thickness than the remaining walls of the main components of safe 11 in order to provide a robust mounting for rod 69 which is received in bore 67 and holes 33. As best shown in FIG. 3 and FIG. 4, there is a pair of vertically spaced apart resilient arms 71, having curved lips 73, that embrace a padlock P, of conventional design. As FIG. 1 shows, an aperture 75 in holder wall 63 allows passage of padlock shackle 77. A latch 79 with engaging tip 81 extends rearwardly from the underside of holder top 61.

Referring to FIGS. 2 through 4 the assembly and operation of safe 11 will be described. The padlock holder 15 is hingedly secured to case 13 by rod 69 which is maintained in place within bore 67 and holes 33 by any number of well known means such as welding the ends of rod 69, etc. The lid 17 may be assembled to the case 13 by raising the end 59 of catch 57 sufficiently to clear the shelf 35, aligning tongues 41 within grooves 25 and slidably advancing lid 17 until end 59 clears the forward edge of shelf 35. Inadvertent removal of lid 17 is prevented by the end 59 engaging shelf 35 as seen in FIG. 4. Padlock P may be installed by spreading arms 71 and sliding it into place within the grasp of arms 71 and lips 73. When safe 11 is in the open configuration as shown in FIG. 4 the keyway of padlock P is easily accessible as is the storage space within case 13.

The safe 11 is attachable to a selected fixed structure by the padlock shackle 77 in the customary manner of padlocks. To achieve the closed position as shown in FIGS. 1 and 3, the holder 15 is then rotated fully inwardly, in which position the side edges of holder 15 lie within recessed seats 28. Lid 17 then may be advanced to its fullest extent during which the engaging tip 81 of latch 79 snaps into locking engagement with combination lock 51. In this closed configuration the recessed lower edge 45 of lid 17 mates with the recessed seat 37 of case 13. It is also noted that the recessed forward edged 47 of lid 39 mates with the lip portion 68 of holder 15 to hold it against opening rotation. The mating tolerences of the main components 13, 15, and 17 are such as to provide close conformance, with thin demarkation lines between components as shown in FIG. 1, and minimal exposed edges so so as to deter tampering of safe 11.

FIG. 5 illustrates a varient of the safe of the invention. This varient has a padlock holder 85 and a case 86 that have a similar construction to the aforedescribed safe 11 however here there is longitudinal tongue 88 on the outside of the sidewalls of case 86. This varient also features a lid 90 which envelopes all sides of holder 85 and case 86 and which is slidably mounted to tongues 88 via grooves 93, for telescopic opening and closing movement. The forward portion of lid 90 shields padlock padlock shackle 95 against cutting tools such as hacksaws and shears.

It should be appreciated that the foregoing is considered as illustrative only of the principals of the invention and that many changes can be made thereto without departing from the scope of the invention.

What is claimed is:

1. Portable safe for securing small items comprising:

a. storage case having a bottom, spaced side walls, and rear wall;

b. padlock holding portion, having a front and top wall, and being adapted to releasably retain a padlock behind said holding portion front wall with the shackle of the padlock protruding forwardly of said holding front wall, said holding portion having latch means depending therefrom, and said holding portion being pivotable from a first, tucked position in which said holding portion top wall is aligned with the upper edges of the side walls of said case to an open position in which the keyway of the padlock is elevated; and c. lid portion, including top wall, said lid having a lock mechanism affixed thereto, and said lid slidably mounted to the upper part of said case for longitudinal movement from a position in which said compartment is open, to a shut position is which said compartment is covered and said locking mechanism makes engagement with said latch means and said lid engages said holding portion to prevent movement from its tucked position.

2. Device as defined in claim 1 wherein slots in said case are slidably engaged by said lid.

3. Device as defined in claim 1 wherein slots in said lid engage said case.

4. Device as defined in claim 1 wherein the rear wall of said case extends upwardly from the bottom of said case for a substantial fraction of the height of said case and wherein said lid has a downwardly extending rear wall having a lower edge that mates with the top edge of said case rear wall.

5. Device as defined in claim 4 wherein the rear wall of said case has a lip portion that extends logitudinally and inwardly.

6. Device as defined in claim 4 wherein the side edges of said lid rear wall are seatable within the confines of said case side walls when said lid is shut.

7. Device as definedin claim 4 wherein the top edge portion of said case rear wall is adapted to hold said lid rear wall against inward deformation.

8. Device as defined in claim 1 wherein the top wall of said padlock holding portion has means extending therefrom for being received by a part of said case to prevent non-pivoting forward movement of the top wall of said holding portion.

9. Device as defined in claim 1 wherein said locking mechanism is a combination lock.

10. Device as defined in claim 1 wherein said locking mechanism is affixed to the top wall of said lid.

11. Device as defined in claim 1 including resilient catch means depending from the inside of said lid for engaging an inside part of said case to hold said lid against complete removal from said case, whereby said catch means is biasable to disengage from said case to allow lid removal.

12. Device as defined in claim 1 wherein said lid portion has top, bottom and side walls and is adapted internally to telescopically and slidably receive said case and padlock holding portion and wherein the forward portions of the walls of said lid envelope the shackle of the padlock when said lid is in its shut position.

* * * * *